US005423168A

United States Patent [19]

Kolmes et al.

[11] Patent Number: 5,423,168

[45] Date of Patent: Jun. 13, 1995

[54] SURGICAL GLOVE AND YARN

[76] Inventors: Nathaniel H. Kolmes, 1740 5th Street, NW., Hickory, N.C. 28601; Harold F. Plemmons, Rte. #1, Box #628, Millers Creek, N.C. 28651

[21] Appl. No.: 641,785

[22] Filed: Jan. 16, 1991

Related U.S. Application Data

[63] Continuation-in-part of Ser. No. 366,886, Jun. 13, 1989, abandoned, which is a continuation-in-part of Ser. No. 176,075, Mar. 31, 1988, and a continuation-in-part of Ser. No. 202,338, Jun. 6, 1988, Pat. No. 4,838,017, said Ser. No. 176,075, is a continuation of Ser. No. 766,846, Aug. 16, 1985, abandoned, said Ser. No. 202,338, is a continuation of Ser. No. 915,140, Oct. 3, 1986, abandoned.

[51] Int. Cl.[6] ..... D02G 3/12; D02G 3/18

[52] U.S. Cl. ..... 57/229; 57/230

[58] Field of Search ..... 57/210, 212, 222, 229, 57/230

[56] References Cited

U.S. PATENT DOCUMENTS

| | | | |
|---|---|---|---|
| 2,335,644 | 11/1943 | Camp | 57/229 |
| 3,490,224 | 1/1970 | Bourgeas | 57/210 |
| 4,321,854 | 3/1982 | Foote et al. | 57/210 |
| 4,384,449 | 5/1983 | Byrnes et al. | 57/210 |
| 4,470,251 | 9/1984 | Bettcher | 57/210 |
| 4,640,179 | 2/1987 | Cameron | 57/210 |
| 4,777,789 | 10/1988 | Kolmes et al. | 57/210 |
| 4,838,017 | 6/1989 | Kolmes et al. | 57/210 |
| 4,936,085 | 6/1990 | Kolmes et al. | 57/229 |

*Primary Examiner*—Joseph J. Hail, III

*Attorney, Agent, or Firm*—Spencer, Frank & Schneider

[57] ABSTRACT

A cut resistant glove knitted from a yarn worn under a surgical glove without adversely affecting the dexterity of the person wearing the glove, said yarn being cut resistant and including a core and a covering about the core, said covering including at least two strands wrapped in opposite directions, relative to each other, about the core strand, said yarn as formed having a denier in the range of about 175 to about 1,250.

7 Claims, 1 Drawing Sheet

SURGICAL GLOVE AND YARN

CROSS-REFERENCE TO RELATED APPLICATIONS

This application is a continuation-in-part of prior application Ser. No. 07/366,886, filed Jun. 13th, 1989, now abandoned, which was in turn, a continuation-in-part of prior applications Ser. Nos. 07/176,075, filed Mar. 31st, 1988, and 07/202,338, filed Jun. 6th, 1988, and now U.S. Pat. No. 4,838,017. The aforementioned prior application No. 07/176,075 was, in turn, a continuation of application Ser. No. 06/766,846, filed Aug. 16th, 1985, and now abandoned. The aforementioned prior application No. 07/202,338, was, in turn, a continuation of application Ser. No. 06/915,140, filed Oct. 3rd, 1986, and now abandoned. All of the foregoing are hereby incorporated by reference.

BACKGROUND OF THE INVENTION

The present invention relates generally to yarns, fabrics and protective garments knitted of such yarns and, more particularly, to an improved lightweight yarn which may be knitted into an improved, more comfortable, more flexible lightweight protective garment, such as a glove, which may be worn by a surgeon underneath a rubber or latex surgical glove.

In our prior applications referred to above and in our prior U.S. Pat. No. 4,777,789, we described certain technological advantages of various configurations of yarns, for use in protective garments, and technological advantages of certain fibers which may be utilized in yarns for protective garments. The applications and patent, and the references cited in each, describe numerous uses for cut-resistant yarns and garments such as, but not limited to, the meat processing industry. The yarns described in the prior applications and patent are all suitable for the purposes described therein.

It is well known that surgeons, pathologists, laboratory technicians and persons involved in research with animals wear sterile, protective gloves commonly referred to as "rubber" gloves which are, in fact, usually made of latex. Latex gloves serve the dual purpose of providing a sterile glove and protecting the hands of the wearer against various microorganisms. Latex gloves, however, do not provide any meaningful protection against accidental nicks and cuts from a scalpel or the like. Thus, prior to the present invention, there was no known protection for persons who wore rubber surgical gloves and who were exposed to the risk of accidental cuts from the blades of scalpels or from other sharp edges.

SUMMARY OF THE INVENTION

The present invention provides a new approach in connection with protecting the hands of the wearer of thin rubber gloves by providing a cut-resistant yarn and glove which may be worn by a surgeon under a rubber glove and which does not materially affect the dexterity of the wearer.

The yarn and glove, according to the principles of the present invention, may be best understood by considering the concept of denier of a fiber or a yarn. The denier of a yarn, fiber or the like, is a standard unit of measurement of the weight of a yarn as a function of its length. Stated alternatively, the denier may be thought of as the yield in terms of yards per pound of fiber. A denier of one is a yield of approximately 4.4 million yards per pound.

We have discovered that by maintaining the total denier in a range of about 175 to about 1,250, suitable slash or cut-resistance may be obtained, according to the principles of the present invention, while still providing the wearer with sufficient dexterity such that upon wearing a glove knitted of a yarn, according to the principles of the present invention, and upon placing a conventional latex glove over such a knitted glove, the wearer of the gloves will still have the ability to retrieve an item such as a needle from a flat, horizontal surface.

BRIEF DESCRIPTION OF THE DRAWINGS

The various benefits and advantages of the present invention will be more easily understood upon reading the following detailed description of the invention taken in conjunction with the drawings.

In the drawings, wherein like reference numerals identify corresponding components.

DETAILED DESCRIPTION OF THE INVENTION

Figure 1:
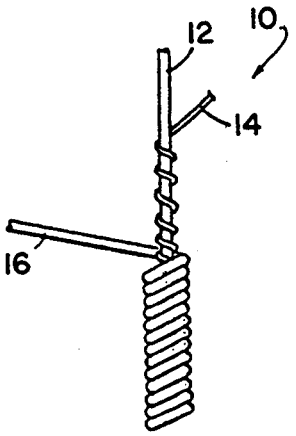
FIGS. 1–5 are illustrations of five embodiments of yarn according to the principles of the present invention.

With reference to the drawings, FIG. 1 illustrates a three-ply, or three piece yarn 10 comprising a core and a covering in accordance with the principles of the present invention. The yarn 10 includes a core strand 12 and two covering strands or wraps 14, 16. In a three piece yarn 10, the core strand is formed of fiber. A first covering strand 14, which may be wire or fiberglass, is wrapped around the core strand 12, and a second covering strand 16, which is preferably fiber, is wrapped around both the core strand 12 and the first covering strand 14. Strands 14 and 16 are wrapped in opposite directions, relative to each other, around the core strand. In a first form of the invention according to FIG. 1, strand 12 is a 210 denier Spectra fiber. Spectra is Allied-Signal Corporation's brand of extended chain polyethylene. Wire 14 is an annealed stainless steel grade 304 wire having a diameter of 0.002 inches. Top wrap or covering 16 is also 210 denier Spectra. The effective denier of the yarn formed as just described is approximately 500.

In an alternate form of the invention according to FIG. 1, both the core strand 12 and the top covering 16 are 150 denier textured polyester.

In general, when proceeding according to the principles of the present invention, and not just with regard to the embodiment of FIG. 1, the wire is an annealed stainless steel grade 304 wire having a nominal diameter in the range of 0.0010 to 0.0045 inches and a preferred diameter of 0.0020 inches. Annealed wire is preferred to eliminate any residual magnetic properties. Multiple, thinner strands may be used together to achieve the same, effective total diameter. Thus, by way of example only, three wires each of 0.0015 inch diameter may be used in lieu of one wire having a diameter of 0.0045 inch. Each of the fiber strands may be formed of fibers selected from the group including nylon, aramid, extended chain polyethylene, cotton, wool, fiberglass, polyester, polycotton and asbestos. The fibers used in a single yarn need not be identical in composition or denier. Thus numerous variations are contemplated depending on specific considerations such as cost, texture, etc.

Another form of the embodiment of FIG. 1 includes a 0.0020 inch wire strand 14 and two fiber strands 12, 16, each of 210 denier multifilament polyester. In accordance with the principles of the present invention, if one strand 14 of 0.0020 inch diameter wire is provided, and two strands 12, 16 are each of 70 denier fiber, the total denier of a yarn constructed according to FIG. 1 would be approximately 175.

Alternatively, the yarn of FIG. 1 may have a core strand 12 of 70 denier nylon, a first wrap 14 of 50 denier fiberglass, and a top covering strand 16 of 70 denier nylon, thus providing a yarn having an effective denier of about 200. It must be appreciated that the denier is not merely additive because the wrapping of the covering strands on the core increases the denier of the yarn.

Alternate constructions of the yarn of FIG. 1 include a core strand 12 of 375 denier (either nylon or extended chain polyethylene) and a covering including a first wrap 14 of 50 denier fiberglass and a top wrap 16 also of 375 denier nylon or extended chain polyethylene. In this instance, the denier of the composite yarn would be in the range of about 800–900.

Still another alternate construction of the yarn of FIG. 1 would include a core strand 12 of nylon having a denier from about 70 to about 400, preferably 210, and a covering comprising a first or inner wrap 14 of 0.0020 inch diameter wire and a second or outer wrap 16 of nylon, extended chain polyethylene, aramid or polyester having a denier of about 150. The denier of the composite yarn as thus described would be between about 250 and about 600, and if 210 denier nylon was the specific core strand, the denier of the yarn would be about 400.

Thus the alternate embodiments of FIG. 1 would provide a yarn having an effective denier from about 175 to about 900.

Figure 2:
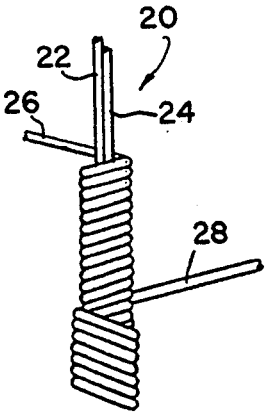

Referring next to FIG. 2, a preferred yarn, namely a four-ply yarn 20 is illustrated which yarn includes a core and a covering. The core is illustrated as including two strands 22, 24 which are preferably placed parallel to each other (although they may be twisted or braided together) and covered by two covering strands 26, 28 which are wrapped in opposite directions relative to each other around the core. Numerous compositions of the yarn illustrated in FIG. 2, when knitted into a glove, provide the desired result of cut resistance while allowing the wearer of the glove to retain the necessary dexterity. One such composition yarn of FIG. 2 is a first core strand of 210 denier multifilament polyester a second core strand of 0.0020 inch diameter wire, and two covering strands each of 210 denier multifilament polyester thus yielding an effective denier of about 850. A second composition of the yarn of FIG. 2 includes a first core strand of 210 denier extended chain polyethylene, a second core strand of 0.0020 inch wire, and two covering strands each of 375 denier multifilament polyester, yielding an effective denier of about 1200. Additional compositions for the yarn of FIG. 2 (all references being contrasted to the first example of a yarn composition according to FIG. 2) include the use of 210 denier nylon as the outer (or alternatively as both) coverings, the use of extended chain polyethylene in both the core and the first covering strand, and the use of nylon in place of extended chain polyethylene as the core strand.

Further alternate compositions for the yarn of FIG. 2 will now be explained. One such composition includes a core having a strand of 185 denier nylon and a wire strand having a diameter of 0.0020 inch, the two core strands placed parallel to each other, and wrapped with a first covering strand 26 of 185 denier nylon and a second covering strand 28 of 185 denier nylon. The total denier of yarn configured as described is about 750. Another composition of the yarn of FIG. 2 includes a core having a strand of 40 denier nylon and a 0.0010 inch diameter wire strand covered by two nylon strands each of 70 denier and thus the yarn would have a total denier of about 200.

In the different yarn compositions of FIG. 2, a 50 denier fiberglass strand may be utilized in place of a wire strand in the core. Polycotton fiber having a denier of 375 about may be substituted for the nylon strands while retaining the benefits and advantages of the present invention.

Figure 3:
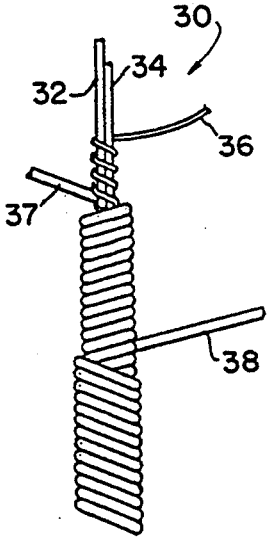

Referring next to FIG. 3, a five piece yarn 30 is illustrated again including a core and a cover. The core is formed of two strands 32, 35, one of which is preferably wire or fiberglass having a diameter in the range heretofore described. Alternatively, both core strands 32, 34 may be fiber such as 210 denier polyester. The covering includes a total of three strands, a first or innermost strand 36 wrapped around the core, a second or next outermost strand 37 wrapped around the innermost strand 36, and a third or topmost strand 38 wrapped around strand 37. Strands 36 and 37 are wrapped in opposite directions relative to each other, about the core, and strands 37 and 38 are wrapped in opposite directions, relative to each other, about the core. Strand 36 may be wire or nylon, and strands 37 and 38 may, for example, be any of the fibers heretofore described, and should preferably each have a denier in the range of about 150 to about 300. If both core strands are fiber, then the first wrap or cover strand should be either wire or fiberglass. The total denier of the yarn of FIG. 3 will be in the range of 950–1150. Again it must be appreciated that finer denier fibers, e.g., 70 denier each, may be utilized for strands 32, 36, 37 and 38 and, with a wire strand 34, the total denier of the yarn would be about 500 to 600. Thus each configuration is illustrative of the principles of the present invention, and the specific examples of denier sizes for each configuration are merely illustrative of the principles of the present invention.

Figure 4:
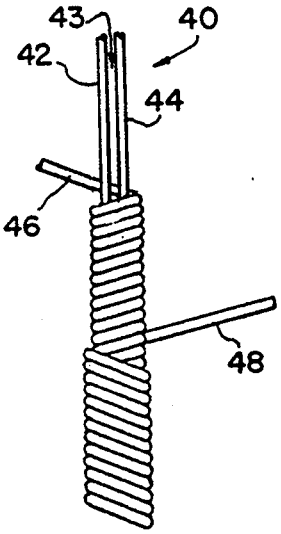

FIG. 4 illustrates an alternate form of a five-piece or five-ply yarn 40 having three core strands and two covering strands. The three core strands 42, 43 and 44 may be twisted or braided together or placed parallel to each other and may be wire, 50 denier fiberglass, 210 denier nylon, 375 denier polyester or any one of the other fiber materials heretofore mentioned, although preferably at least one core strand should be either wire or fiberglass. The core strands need not be identical as to material or denier. The covering strands 46 and 48 are wrapped in opposite directions, relative to each other, about the core strands and will preferably be 210 denier nylon. A yarn 40 configured as described, using the materials and deniers heretofore described, will also have a total denier in the range of about 950–1150. One composition of yarn in the embodiment of FIG. 4 would be a core having one 0.0020 inch diameter wire strand and 2–210 denier polyester fiber strands, and two covering strands, each of 210 denier polyester.

Figure 5:
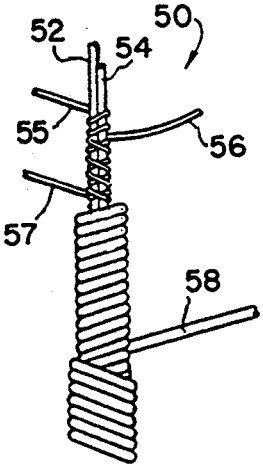
Figure 6:
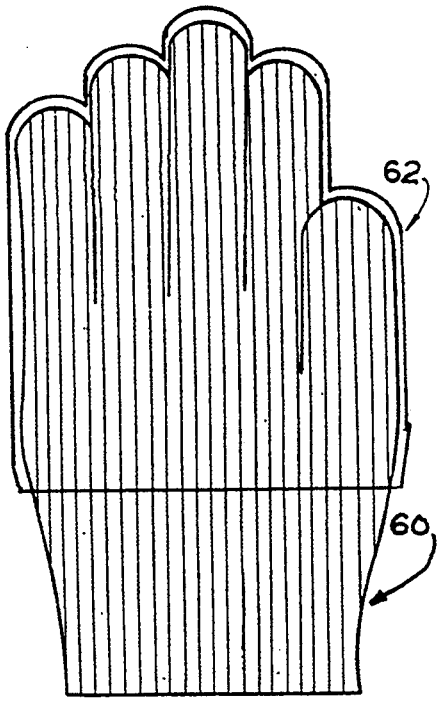
FIG. 6 is an illustration of one form of a protective garment, namely, a glove, made in accordance with the principles of the present invention, and further illustrating one use of such a glove in combination with a rubber or latex glove.

FIG. 5 illustrates a six-ply yarn 50 having two core strands, a first pair of covering strands forming a first covering and two additional covering strands forming a second covering. By way of further example, with respect to FIG. 5, the core may include two strands 52, 54, one of 185 denier extended chain polyethylene and the second of 0.0020 diameter wire, either twisted together or placed parallel to each other. The first covering includes two strands 55, 56, wrapped about the core in opposite directions relative to each other and may be two wire strands each having a diameter of 0.0015 inches. Thereafter, covering strands 57 and 58 are wrapped around the covering strands 55, 56, the covering strands 57 and 58 being wrapped in opposite directions, relative to each other, about the core, and each being 185 denier extended chain polyethylene or nylon. The composite denier of a yarn as described above would be about 900. An alternate composition for the yarn of FIG. 5 would be a core strand of 0.0025 inch diameter wire and a core strand of 100 denier nylon, two fiber covering strands 55, 56, each being 100 denier nylon and two outer covering strands 57 and 58, each being a multifilament 70/34 polyester. This last nomenclature, of course, refers to a multifilament bundle where 70 is the total denier of the bundle, and 34 is the number of monofilament strands within the bundle.

It may be appreciated that the various fibers heretofore described may be substituted for the specific examples given, although preferably the core will include a wire strand or a fiberglass strand except in the three ply embodiment of FIG. 1, wherein an unsupported wire or fiberglass core strand appears not to be machine knittable. The particular weights or deniers of the individual fibers are given as illustrative to demonstrate that by utilizing different yarn compositions, a total denier in the range of about 175 to about 1250 is feasible. The particular nylon is preferably a low-shrink nylon. If an aramid is used, it is preferably Kevlar manufactured by Dupont. As mentioned previously, if extended chain polyethylene is utilized, it is preferably Spectra, manufactured by Allied-Signal Corporation. The present invention contemplates the use of monofilaments, multifilaments and when fiberglass is utilized, it is preferably E glass. When a strand is described, such as a 420 denier, it is equivalent to two-210 denier strands. When a wire strand of 0.0020 inch diameter is described, it is equivalent to two-0.0010 inch diameter wire strands.

The yarn in each embodiment may be formed on a standard, hollow spindle covering machine set at about 4–12 turns per inch. The yarn may thereafter be knitted into a glove 60 on a conventional knitting machine such as a Shima Seiki. The present invention contemplates a glove 60 to be worn under a convention surgical rubber or surgical latex glove 62.

If the glove is to be knitted on a conventional 13 gauge knitting machine, and if a total denier of about 750 and a four ply composition as illustrated in FIG. 2, .are desired, wire and polyester in the core and polyester as the covering, appears to be an optimum composition when the core yarn is covered at the rate of about 8 or 9 turns per inch. However, the concept of an optimum composition or a preferred composition takes into account economics as well as softness, appearance, cut resistance, washability, lack of impairment of dexterity, and other factors which are necessarily subjective in nature.

For total deniers above 750 or 800, a 7 gauge knitting machine is preferred rather than a 13 gauge knitting machine.

Gloves knitted of yarn according to any of the embodiments of the present invention have substantial slash resistance in that the glove may be placed on the hand of the wearer, and a knife or scalpel drawn across the palm of the hand, for example, without penetrating the yarn. When a glove 60 formed of a yarn of any of the embodiments of the present invention is placed on the hand of the wearer and thereafter a latex surgical glove 62 placed over the glove 60 of the present invention, there is sufficient dexterity or "feel" such that the wearer of a gloves may pick up a needle from a horizontal surface such as a table or the like, by merely grasping the needle between the thumb and forefinger.

The foregoing is a complete description of the preferred embodiment of the present invention. The various thicknesses and constructions as illustrated herein, and the specific fibers as described herein are equally satisfactory for the intended purpose of a cut-resistant yarn although clearly the more wire and fiberglass in the yarn, the greater the slash resistance. Also, thicker yarn provides resistance to working at lower temperatures, which may be of importance to pathologists.

Depending upon the particular fibers utilized, the glove, according to the present invention, may be washed, sterilized or the like, recognizing, however, that chlorine bleaches attack aramid fibers and that higher temperatures can adversely affect extended chain polyethylene fibers. However, if the yarn comprises fiberglass, wire, nylon and polyester, or combinations and permutations of those fibers, the glove may be sterilized in typical hospital fashion such as autoclaving or the like without a reduction of cut-resistance and without shrinking of the glove or any other physical result to the glove which would tend to impair the dexterity of the wearer.

The foregoing is a complete description of the present invention. Various changes and modifications may be made without departing from the spirit and scope of the present invention. The invention, therefore, should be limited only by the following claims.

What is claimed is:

1. In combination, a surgical glove made out of latex and a flexible glove formed of a yarn positioned interiorly of the surgical glove, the yarn being a cut resistant yarn for forming a flexible glove to be worn under the surgical glove, the yarn comprising:

a core having at least two strands, at least one of which is selected from the group consisting of metal and fiberglass, and at least one strand being essentially free of metal and fiberglass; and a covering wrapped around the core;

the covering including at least first and second strands wrapped in opposite directions, relative to each other, about the core, at least one of the covering strands being essentially free of metal and fiberglass;

the yarn having a denier between about 200 and about 1200.

2. The combination according to claim 1, wherein said core strands are placed parallel to each other.

3. The combination according to claim 1, wherein at least one of said covering strands is formed of fibers selected from the group consisting of aramid, extended chain polyethylene, nylon, polyester, polycotton, asbestos, and fiberglass.

4. The combination according to claim 1, wherein the strands which are essentially free of metal and fiberglass in the core and in the covering are formed of dissimilar fibers.

5. The combination according to claim 1, wherein said covering includes at least three strands wrapped about said core, two of said strands wrapped in the same direction, relative to each other, about said core, and the third strand wrapped in the opposite direction about said core.

6. The combination according to claim 1, wherein said core includes at least three strands.

7. The combination according to claim 1, wherein said covering includes at least four strands wrapped about the core, two of said covering strands wrapped in a first direction around the core and two of said strands wrapped in a second direction around the core, said first and second directions being opposite to each other.

* * * * *